US007098865B2

(12) United States Patent
Christensen et al.

(10) Patent No.: US 7,098,865 B2
(45) Date of Patent: Aug. 29, 2006

(54) BEAM FORMING ARRAY OF TRANSDUCERS

(75) Inventors: Jacob Juhl Christensen, Copenhagen (DK); Jorgen Hald, Roskilde (DK)

(73) Assignee: Bruel and Kjaer Sound and Vibration Measurement A/S, Naerum (DK)

( * ) Notice: Subject to any disclaimer, the term of this patent is extended or adjusted under 35 U.S.C. 154(b) by 0 days.

(21) Appl. No.: 10/507,753

(22) PCT Filed: Mar. 14, 2003

(86) PCT No.: PCT/DK03/00166

§ 371 (c)(1),
(2), (4) Date: Jan. 4, 2005

(87) PCT Pub. No.: WO03/079486

PCT Pub. Date: Sep. 25, 2003

(65) Prior Publication Data

US 2005/0225497 A1 Oct. 13, 2005

(30) Foreign Application Priority Data

Mar. 15, 2002 (DK) ..... PA 2002 00412

(51) Int. Cl.
*H01Q 21/00* (2006.01)
*H04R 3/00* (2006.01)

(52) U.S. Cl. ..... 343/893; 381/92

(58) Field of Classification Search ..... 343/893; 381/92

See application file for complete search history.

(56) References Cited

U.S. PATENT DOCUMENTS

| | | | | |
|---|---|---|---|---|
| 4,754,286 | A | 6/1988 | Brunner et al. | 343/771 |
| 4,797,682 | A | 1/1989 | Klimczak | 343/844 |
| 5,838,284 | A | 11/1998 | Dougherty | 343/893 |
| 6,115,005 | A | 9/2000 | Goldstein et al. | 343/895 |
| 6,205,224 | B1 | 3/2001 | Underbrink | 381/92 |
| 6,433,754 | B1 | 8/2002 | Boeringer | 343/893 |
| 6,583,768 | B1 * | 6/2003 | Underbrink | 343/893 |
| 6,670,931 | B1 * | 12/2003 | O'Connell | 343/893 |

* cited by examiner

*Primary Examiner*—Tho Phan

(74) *Attorney, Agent, or Firm*—Oliff & Berridge, PLC

(57) ABSTRACT

A two-dimensional array of a plurality of transducers comprising a first plurality of like sub-arrays (11, 11*a*, 11*b*) of transducers (10) in a circularly symmetric arrangement around a common centre (C), where the transducers in each sub-array of the first plurality have individual distances from the common centre that form a progressive series of distances with a first lower limit and a first upper limit. Each sub-array in the first plurality of sub-arrays comprises at least three transducers arranged on a first straight line (12), and the first straight line is offset laterally a first distance (d) from the common centre. The number of sub-arrays is odd, and the sub-arrays may be separate units that can be selectively assembled to form the two-dimensional array and selectively disassembled.

17 Claims, 2 Drawing Sheets

BEAM FORMING ARRAY OF TRANSDUCERS

This application is a 371 of PCT/DK03/00166, filed on Mar. 14, 2003.

FIELD OF THE INVENTION

The present invention relates to planar or two-dimensional arrays of a plurality of transducer elements. More specifically, the invention relates to such arrays comprising a first plurality of like sub-arrays of transducers in a circularly symmetric arrangement around a common centre, where the transducers in each sub-array of the first plurality have individual distances from the common centre that form a progressive series of distances.

BACKGROUND OF THE INVENTION

Such arrays of transducers are used as phased arrays for focusing the sensitivity of the array in a desired direction. Preferably, the array should be usable in a broad frequency range. Phased arrays are usable as receiving arrays, eg for locating a signal source or for producing a two-dimensional image of one or more point sources or distributed sources, or for selecting signals from a particular source and excluding or attenuating signals from other sources. Phased arrays are also usable as transmitting arrays, eg for target illumination with projected beams. Signals that can be handled, ie received or transmitted, by such arrays are wave-energy signals having wavelengths that are comparable to the dimensions of the array and/or to the distances between individual transducers in the array.

Examples of such wave energy are sound energy within the audible frequency range or infrasound or ultrasound, which are outside the audible frequency range. In case of sound energy, receiving transducers are referred to as microphones, and transmitting transducers are referred to as speaker transducers. Another example of wave energy is electromagnetic energy such as radio frequency (RF) energy that can be received or emitted by suitable antennas eg for mapping the RF landscape or for focusing on a fixed or moving source or target.

With a given number of transducer elements, ie sensors or emitters, in the array, it is often an objective when designing the array to obtain a non-redundant distribution of the transducer elements, and at the same time to obtain a broad usable frequency range, good suppression of side lobes and near circular symmetry. Circular symmetry is also referred to as rotational symmetry and means that through rotation of a fraction 1/n, where n is an integer, of 360 degrees the array will cover it self or be in an identical position. Non-redundancy means that no spacing vector between any two transducer-elements is repeated. A non-redundant array has the advantage that with the given number of elements the maximum number of distinct lags is sampled. Thus, a non-redundant array provides a near optimum array design with respect to spatial sampling characteristics of the array.

The maximum side lobe level in the beam pattern of an array is a measure of its ability to reject unwanted signals and noise and to focus on particular propagating signals. It is therefore important to achieve good side lobe suppression for the array.

Circular symmetry of the array is desirable, because otherwise the source map resolution or a projected beam tends to be azimuth angle dependent.

Prior art arrays have been designed in seeking to meet the above-mentioned requirements including irregular arrays such as random arrays and logarithmic spiral arrays.

U.S. Pat. No. 5,838,284 discloses an array of transducers arranged on a single logarithmic spiral having several turns.

U.S. Pat. No. 6,205,224 discloses a circularly symmetric planar array. Its transducer elements are arranged on a plurality of identical logarithmic spirals at locations where the spirals intersect concentric circles of specified diameters.

When carefully designed such arrays are fairly successful in meeting the requirements. However, due to their complicated geometry they are difficult both to manufacture and also to operate. Also, the need for high resolution in the far field can only be met with relatively large dimensions of the arrays. Thus, an array with a diameter of several meter is often required. In connection with outdoor applications it is therefore of practical importance that the array construction allows for easy assembly and disassembly at the site of use, and for easy transport.

It is the object of the invention to provide a planar array with a simple geometry, which, without compromising non-redundancy, circular symmetry or well-controlled side lobe suppression, allows easy manufacturing and operation.

SUMMARY OF THE INVENTION

According to the invention this object is achieved by arranging the transducers in each sub-array on a straight line. A straight line is the simplest possible geometry to manufacture. When such a linear sub-array is manufactured as rods or arms, which possibly are detachable, deviations from the prescribed linear geometry can easily be detected by visual inspection. Possible damage to arms can easily be detected, and damaged arms can be replaced or repaired. All sub-arrays being identical further simplifies the manufacturing and handling.

The straight lines defined by the transducers in each transducer sub-array can be offset laterally a distance from the common centre. Hereby the array size is increased, which improves the spatial resolution. By having an odd number of sub-arrays and by suitably positioning the transducers along the straight line the non-redundancy of the array can be ensured.

An array where the sub-arrays are separate units that can be selectively assembled to form the two-dimensional array and selectively disassembled has several advantages. In order to have good directivity at low frequencies, the overall or outer diameter of the array must be fairly large, typically 2 m or more. Transporting such large arrays safely to and from the site of use is a challenge, and the risk of the array being damaged during transport and handling is substantial. The invention solves this problem by providing the sub-arrays as separate units that can be selectively assembled to form the two-dimensional array and selectively disassembled. The disassembled linear sub-arrays can then be supplied, transported and stored side-by-side in eg a suitable box, which takes up considerably less space than the assembled array, and which protects the sub-arrays against damage.

Preferably, the transducers in each sub-array are connected to a common plug on the respective separate unit, allowing all these transducers to be connected by a single cable to the data acquisition hardware. This highly reduces the complexity of the cabling.

Arrays of this kind are designed for use in a specified frequency range and have a well defined and carefully designed suppression of side lobes.

A planar array has sensing or transmitting transducer elements arranged on an odd number of identical linear sub-arrays or arms, which are angularly spaced uniformly about an origin or common centre. The arms are identical in the sense that all arms have the same configuration, and the positions of the transducers are the same on all arms. Also, any arm can be obtained from any other arm by rotation of the entire array around the origin of the array. This is called circular or rotational symmetry, which means that the entire structure repeats itself an integer number of times when rotated through 360 degrees around its centre.

The circularly symmetric array is made non-redundant by the odd number of arms, and by choosing the element positions so that no inter-element spacing vector is repeated on the arms. The diameter of the array is determined by the desired spatial resolution at the lower operation frequency, and the exact lateral offset of the sub-arrays and the element positions are determined using a numerical optimisation routine, which adjusts these parameters until all array pattern side lobes below a specified upper operation frequency have been minimized.

Any such array is usable in a specific frequency range, and the array is less usable or possibly not usable at all outside that frequency range. If measurements are desired outside the usable frequency range, another array, which is designed for use in that frequency range will have to be used. The invention offers a composite array covering a broader frequency range.

The array of the invention is usable as a phased array with suitable electronic circuits for operating the transducers of the array.

DETAILED DESCRIPTION OF THE INVENTION

The invention will be described with microphones used as the preferred transducers.

Figure 1:
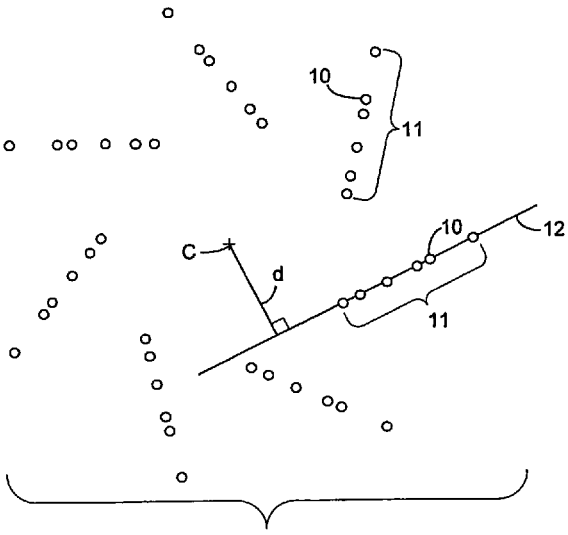
FIG. 1 is a diagrammatic view of a circular symmetric planar array with a plurality of identical linear arrays in accordance with a preferred embodiment of the invention.

FIG. 1 shows a planar, ie two-dimensional, array of microphones 10, where the idealised position of each microphone 10 is marked with a circle. The microphones preferably have uniform physical and acoustical properties, and the microphones 10 are arranged in sub-arrays 11. In the shown embodiment there are seven sub-arrays 11 with six microphones 10 in each sub-array. In each sub-array 11 the microphones 10 are arranged on a straight line 12. The sub-arrays 11 are distributed uniformly around a common centre C, so that rotational or circular symmetry about the common centre C is obtained. Circular symmetry means that the structure repeats itself an integer number of times when rotated through 360 degrees around the centre C. In the shown embodiment with seven sub-arrays the structure repeats it self by rotation through an angle of 360/7 degrees or any integer multiple thereof. The straight lines 12 are offset laterally a distance d from the centre C, whereby none of the straight lines of a sub-array passes through the centre C.

The distribution of the microphones 10 along the straight lines 12 of the individual sub-arrays and the lateral offset distance d from the centre C are chosen primarily to suppress side lobes but also to obtain non-redundancy of the microphones, which means that the spacing vector between any pair of microphones is not repeated in another pair.

In principle, the transducer elements 10 can be distributed in any non-redundant or irregular manner, so that no inter-element spacing vector is repeated. In principle, any number of sub-arrays can be used. However, odd numbers of sub-arrays with irregular inter-element spacing are preferred in order to avoid redundancy.

Figure 2:
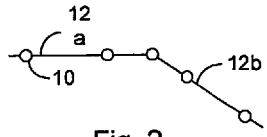
FIG. 2 shows an alternative array with two linear segments for use in a planar array as in FIG. 1.

FIG. 2 shows schematically an alternative arrangement of the microphones 10 in a sub-array for use in an array like the one in FIG. 1. Here the microphones are arranged in two sub-groups, which define two non-parallel straight lines 12*a* and 12*b* intersecting each other and thus forming an angle. Like with the linear sub-arrays 11 in FIG. 1 it is a simple matter to determine by visual inspection, whether a sub-group of the transducers deviate from linearity.

Figure 3:
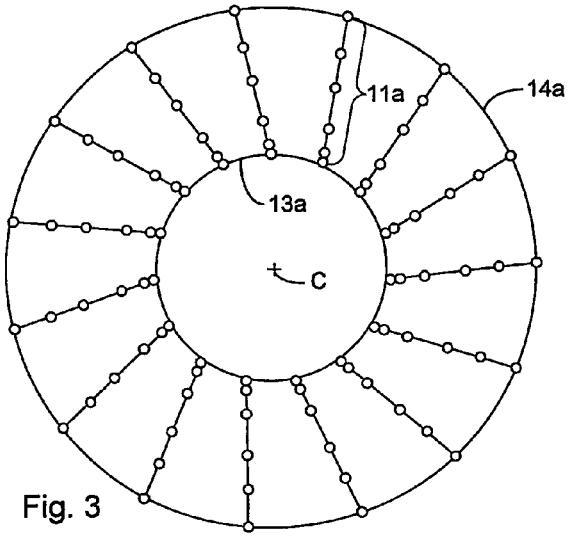
FIG. 3 shows a circular symmetric planar array with the linear arms arranged between an inner ring and an outer ring.
Figure 8:
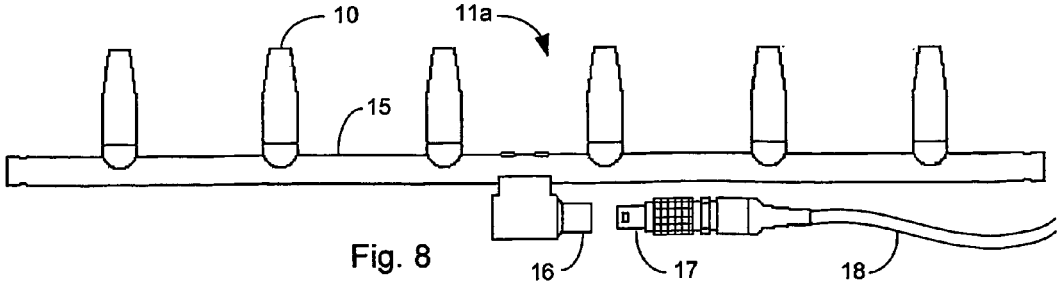
FIG. 8 shows a physical embodiment of a linear array with six transducers mounted on a common linear arm with a plug for connecting a cable.

FIG. 3 shows an array according to the invention with a practical arrangement of microphones in linear sub-arrays 11*a*. FIG. 8 shows one sub-array 11*a* with six microphones 10 rigidly mounted (although with equal spacing) on a rigid, rectilinear rod 15. The array in FIG. 3 is composed of fifteen such sub-arrays 11*a* arranged according to the principles described above in connection with the array in FIG. 1. In the array in FIG. 3 the fifteen sub-arrays 11*a* are rigidly connected to a rigid inner ring 13*a* and a rigid outer ring 14*a*, whereby a rigid array is formed.

Figure 4:
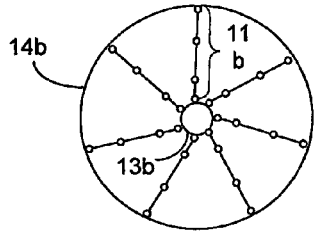
FIG. 4 shows another circular symmetric planar array according to the same principle as in FIG. 3 but suitable for another frequency range.

FIG. 4 shows another array according to the invention, which is constructed in accordance with the same principles as the array in FIG. 3. The array in FIG. 4 has seven sub-arrays 11*b* with four microphones in each sub-array. Like in FIG. 3, the microphones in each sub-array are rigidly mounted on a rigid, rectilinear rod, and each such rod is rigidly secured to a rigid inner ring 13*b* and a rigid outer ring 14*b*, whereby a rigid array is formed.

The arrays in FIGS. 3 and 4 have different overall dimensions, in particular inner and outer diameters, different numbers of sub-arrays and different numbers of microphones in the sub-arrays. They are thereby optimised for use in different frequency ranges.

Figure 5:
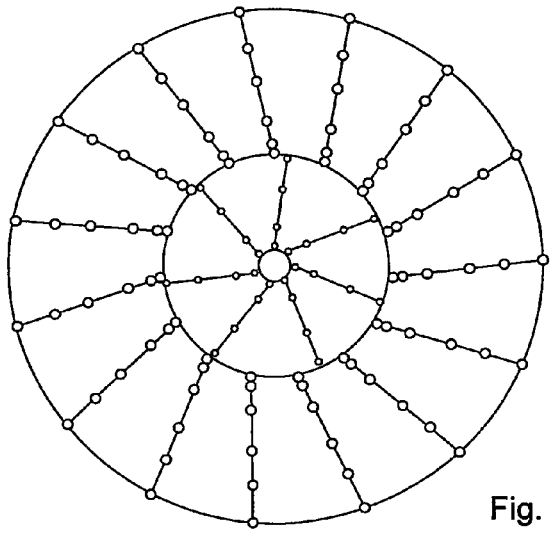
FIG. 5 shows the planar arrays of FIGS. 3 and 4 combined.

FIG. 5 shows a composite array where the arrays in FIGS. 3 and 4 are combined and arranged concentrically. The outer diameter of the smaller array in FIG. 4 can be chosen to closely match the inner diameter of the large array in FIG. 3, or there may be an overlap or spacing between the two arrays. The composite array in FIG. 5 will be usable in a frequency range, which is a combination of the useful frequency ranges of the respective arrays. By properly designing the two arrays and their individual distribution of microphones a further and positive interaction can be obtained, such as an improved suppression of side lobes relative to the individual arrays when used alone.

A preferred microphone distribution and lateral offset of sub-arrays can be obtained by applying a numerical optimisation routine, such as the Minimax minimisation algorithm, for adjusting the position of each microphone in order to minimize all side lobes of the spatial sensitivity pattern of the array below the highest frequency for the intended uses of the array.

Figure 6:
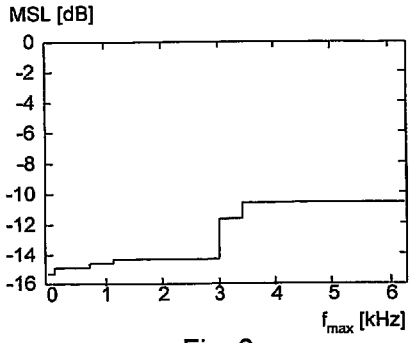
FIG. 6 is a plot of the maximum side lobe levels (MSL) as a function of the maximum operation frequency, $f_{max}$, of the array in FIG. 3.

FIG. 6 shows the maximum side lobe levels (MSL) as a function of the maximum operation frequency, $f_{max}$, of the array in FIG. 3. It is seen that at frequencies below 3 kHz the maximum side lobe level is kept below −14 dB relative to the main lobe, and at frequencies above 3 kHz the maximum side lobe level is kept below −10.5 dB. For a given number of microphones the maximum side lobe levels depend on the result of the optimisation, but the achievable result will also depend on and be limited by the number of microphones used.

FIG. 8 also shows that a connecting plug 16 is secured to the rigid rod 15. The rod 15 is actually a tube, and each of the six microphones 10 on the rigid rod 15 are connected through electrical wires in the interior of the rod 15 to the connecting plug 16. A cable 18 with a plug 17 can be connected to the plug 16, whereby all microphones in the sub-array can be connected through a single cable 18 to a common measuring system.

In the arrays in FIGS. 3, 4 and 5 the sub-arrays 11*a* and 11*b* are assembled with the inner and outer rings 13*a*, 14*a* and 13*b*, 14*b*. This can be done in any suitable manner that ensures the required accuracy and stability of the microphone positions and which is reproducible and allows repeated assembly and disassembly by the user. Suitable means include screws and clamps.

Figure 7:
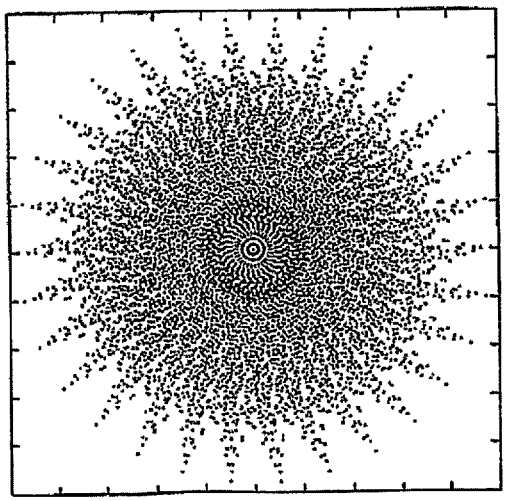
FIG. 7 is a co-array representing the set of all spacing vectors between all pairs of elements in the array aperture in FIG. 3.

Circular symmetry is achieved by spacing the arms uniformly in angle about the common centre C. Due to the combination of an odd number of arms and irregular element distribution the resulting array has no redundancy in its spatial sampling space. This is represented by the co-array shown in FIG. 7, which represents the set of all spacing vectors between any two microphones in the array aperture of FIG. 3. For the present configuration none of these vector differences is repeated.

General design parameters for the present arrays are as follows: (1) number of arms (odd number, at least three); (2) number of transducers in each sub-array; (3) inner radius; (4) length of sub-arrays; (5) lateral offset of the linear sub-arrays from the common centre; (6) distribution of elements along the sub-arrays. When the transducer distribution and lateral offset are determined by application of the aforementioned optimisation routine, these parameters form a broad class of circularly symmetric modular planar arrays whose side lobe characteristics are well controlled in a specified frequency range.

The invention claimed is:

1. A two-dimensional array of a plurality of transducers, the array comprising a first plurality of like sub-arrays of transducers in a circularly symmetric arrangement around a common centre, where the transducers in each sub-array of the first plurality have individual distances from the common centre that form a progressive series of distances with a first lower limit and a first upper limit, characterized in that each sub-array in the first plurality of sub-arrays comprises at least three transducers arranged on a first straight line.

2. An array according to claim 1 characterized in that the first straight line is offset laterally a first distance from the common centre.

3. An array according to claim 2 characterized in that the number of sub-arrays is odd.

4. An array according to claim 2 characterized in that the sub-arrays are separate units that can be selectively assembled to form the two-dimensional array and selectively disassembled.

5. An array according to claim 2, further comprising: a second plurality of like sub-arrays of transducers in a circularly symmetric arrangement around the common centre, where the transducers in each sub-array of the second plurality have individual distances from the common centre that form a progressive series with a second lower limit and a second upper limit, and where each sub-array in the second plurality of sub-arrays comprises at least three transducers arranged on a second straight line.

6. An array according to claim 1 characterized in that the number of sub-arrays is odd.

7. An array according to claim 6 characterized in that the sub-arrays are separate units that can be selectively assembled to form the two-dimensional array and selectively disassembled.

8. An array according to claim 6, further comprising: a second plurality of like sub-arrays of transducers in a circularly symmetric arrangement around the common centre, where the transducers in each sub-array of the second plurality have individual distances from the common centre that form a progressive series with a second lower limit and a second upper limit, and where each sub-array in the second plurality of sub-arrays comprises at least three transducers arranged on a second straight line.

9. An array according to claim 1 characterized in that the sub-arrays are separate units that can be selectively assembled to form the two-dimensional array and selectively disassembled.

10. An array according to claim 9 characterized in that the transducers in each sub-array are connected to a common plug on the respective separate unit, the common plug being connectable to a cable.

11. An array according to claim 10, further comprising: a second plurality of like sub-arrays of transducers in a circularly symmetric arrangement around the common centre, where the transducers in each sub-array of the second plurality have individual distances from the common centre that form a progressive series with a second lower limit and a second upper limit, and where each sub-array in the second plurality of sub-arrays comprises at least three transducers arranged on a second straight line.

12. An array according to claim 9, further comprising: a second plurality of like sub-arrays of transducers in a circularly symmetric arrangement around the common centre, where the transducers in each sub-array of the second plurality have individual distances from the common centre that form a progressive series with a second lower limit and a second upper limit, and where each sub-array in the second plurality of sub-arrays comprises at least three transducers arranged on a second straight line.

13. An array according to claim 1, further comprising:

a second plurality of like sub-arrays of transducers in a circularly symmetric arrangement around the common centre, where the transducers in each sub-array of the second plurality have individual distances from the common centre that form a progressive series with a second lower limit and a second upper limit, and where each sub-array in the second plurality of sub-arrays comprises at least three transducers arranged on a second straight line.

14. An array according to claim 13 characterized in that the number of sub-arrays in the second plurality is odd and that the second straight line is offset a second distance from the common centre.

15. An array according to claim 14 characterized in that the sub-arrays of the second plurality are separate units that can be selectively assembled to form the two-dimensional array and selectively disassembled.

16. An array according to claim 13 characterized in that the sub-arrays of the second plurality are separate units that can be selectively assembled to form the two-dimensional array and selectively disassembled.

17. An array according to claim 16 characterized in that the transducers in each sub-array of the second plurality are connected to a common plug on the respective separate unit, the common plug being connectable to a cable.

* * * * *